US010246213B2

(12) United States Patent
Ayerst

(10) Patent No.: US 10,246,213 B2
(45) Date of Patent: Apr. 2, 2019

(54) CARTON WITH EXPANSION FEATURES

(71) Applicant: Graphic Packaging International, Inc., Atlanta, GA (US)

(72) Inventor: Robert Ayerst, Atlanta, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 116 days.

(21) Appl. No.: 15/448,806

(22) Filed: Mar. 3, 2017

(65) Prior Publication Data

US 2017/0253364 A1 Sep. 7, 2017

Related U.S. Application Data

(60) Provisional application No. 62/303,599, filed on Mar. 4, 2016.

(51) Int. Cl.
*B65D 5/10* (2006.01)
*B65D 5/40* (2006.01)
(Continued)

(52) U.S. Cl.
CPC ..... *B65D 5/0005* (2013.01); *B65D 5/10* (2013.01); *B65D 5/40* (2013.01); *B65D 5/4266* (2013.01); *B65D 5/4608* (2013.01); *B65D 5/54* (2013.01); *B65D 5/62* (2013.01); *B65D 71/36* (2013.01); *B31B 50/26* (2017.08); *B31B 50/81* (2017.08); *B31B 2100/00* (2017.08); *B31B 2110/35* (2017.08); *B65D 5/563* (2013.01); *B65D 81/18* (2013.01); *B65D 2571/0045* (2013.01); *B65D 2571/0066* (2013.01); *B65D 2571/00141* (2013.01); *B65D 2571/00561* (2013.01); *B65D 2571/00728* (2013.01)

(58) Field of Classification Search
CPC ..... B65D 81/18; B65D 7/36; B65D 5/0005; B65D 5/10; B65D 5/40
USPC ..... 229/101, 243
See application file for complete search history.

(56) References Cited

U.S. PATENT DOCUMENTS 1,373,365 A 3/1921 Smouse
3,324,999 A 6/1967 Farquhar
(Continued)

FOREIGN PATENT DOCUMENTS

CA 1079240 6/1980
WO WO 94/20373 A1 9/1994
WO WO 2007/146804 A1 12/2007

OTHER PUBLICATIONS

International Search Report and Written Opinion for PCT/US2017/020595 dated Jul. 4, 2017.

*Primary Examiner* — Justin Larson
(74) *Attorney, Agent, or Firm* — Womble Bond Dickinson (US) LLP

(57) ABSTRACT

A carton for holding one or more containers includes a plurality of panels that extend at least partially around an interior of the carton, a plurality of end flaps foldably connected to the respective plurality of panels to form at least one closed end of the carton, and at least one gusset foldably connected between the at least one side panel and the at least one closed end of the carton. The plurality of panels includes a bottom panel, a top panel, and at least one side panel. The at least one gusset is positionable between a first position and a second position wherein the interior of the carton is expanded.

48 Claims, 8 Drawing Sheets

(51) Int. Cl.

| | |
|---|---|
| ***B65D 81/18*** | (2006.01) |
| ***B65D 5/355*** | (2006.01) |
| ***B65D 5/42*** | (2006.01) |
| ***B65D 5/468*** | (2006.01) |
| ***B65D 5/54*** | (2006.01) |
| ***B65D 5/62*** | (2006.01) |
| ***B65D 71/36*** | (2006.01) |
| *B65D 5/56* | (2006.01) |
| *B31B 50/26* | (2017.01) |
| *B31B 50/81* | (2017.01) |
| *B31B 100/00* | (2017.01) |
| *B31B 110/35* | (2017.01) |

(56) References Cited

U.S. PATENT DOCUMENTS

| | | | | |
|---|---|---|---|---|
| 3,355,089 | A | 11/1967 | Champlin | |
| 3,447,735 | A | 6/1969 | Whitney | |
| 3,886,901 | A | 6/1975 | Zeitter | |
| 4,068,795 | A | 1/1978 | Forster | |
| 4,328,923 | A | 5/1982 | Graser | |
| 4,449,633 | A | 5/1984 | Johnson et al. | |
| 5,016,813 | A | 5/1991 | Simons | |
| 5,094,359 | A | 3/1992 | DeMars et al. | |
| 5,170,934 | A | 12/1992 | Lemoine | |
| 5,307,986 | A | 5/1994 | Schuster | |
| 5,495,727 | A * | 3/1996 | Strong | B65D 81/18 229/101 |
| 7,611,042 | B2 | 11/2009 | Bates et al. | |
| 7,717,318 | B2 | 5/2010 | Brand | |
| 7,926,295 | B2 | 4/2011 | Brand | |
| 8,100,320 | B2 | 1/2012 | Brand | |
| 8,136,717 | B2 | 3/2012 | DePaula et al. | |
| 8,191,761 | B2 | 6/2012 | Brand | |
| 8,459,533 | B2 | 6/2013 | Requena et al. | |
| 8,479,525 | B2 | 7/2013 | Brand | |
| 8,556,160 | B2 | 10/2013 | Spivey, Sr. | |
| 8,727,204 | B2 | 5/2014 | Burke | |
| 8,911,339 | B2 | 12/2014 | DePaula et al. | |
| 8,978,963 | B2 | 3/2015 | Kastanek et al. | |
| 9,113,648 | B2 | 8/2015 | Burke | |
| 9,376,244 | B2 | 6/2016 | Kastanek et al. | |
| 9,656,779 | B2 | 5/2017 | Arki | |
| 9,938,035 | B2 * | 4/2018 | Block | B65D 5/0005 |
| 2007/0284424 | A1 | 12/2007 | Holley | |
| 2012/0091192 | A1 | 4/2012 | DePaula et al. | |
| 2012/0211552 | A1 * | 8/2012 | Kastanek | B65D 71/36 229/101 |
| 2012/0280025 | A1 | 11/2012 | Smalley | |
| 2015/0151889 | A1 * | 6/2015 | Kastanek | B65D 71/36 206/427 |

* cited by examiner

CARTON WITH EXPANSION FEATURES

CROSS-REFERENCE TO RELATED APPLICATION

The present application claims the benefit of U.S. Provisional Patent Application No. 62/303,599, filed on Mar. 4, 2016.

INCORPORATION BY REFERENCE

The disclosure of U.S. Provisional Patent Application No. 62/303,599, filed on Mar. 4, 2016, is hereby incorporated by reference for all purposes as if presented herein in its entirety.

BACKGROUND OF THE DISCLOSURE

The present disclosure generally relates to a carton for holding and displaying containers, and particularly cartons having expansion features and liquid-tight or leakage resistant features.

SUMMARY OF THE DISCLOSURE

According to one aspect of the disclosure, a carton for holding one or more containers comprises a plurality of panels that extend at least partially around an interior of the carton, a plurality of end flaps foldably connected to the respective plurality of panels to form at least one closed end of the carton, and at least one gusset foldably connected between the at least one side panel and the at least one closed end of the carton. The plurality of panels comprises a bottom panel, a top panel, and at least one side panel. The at least one gusset is positionable between a first position and a second position wherein the interior of the carton is expanded.

According to another aspect of the disclosure, a blank for forming a carton for holding one or more containers comprises a plurality of panels for folding at least partially around an interior of the carton when the carton is formed from the blank, a plurality of end flaps foldably connected to the respective plurality of panels for folding to form at least one closed end of the carton when the carton is formed from the blank, and at least one gusset foldably connected between the at least one side panel and the at least one closed end of the carton when the carton is formed from the blank. The plurality of panels comprises a bottom panel, a top panel, and at least one side panel. The at least one gusset is positionable between a first position and a second position wherein the interior of the carton is expanded.

According to another aspect of the disclosure, a method of forming a carton for holding one or more containers comprises obtaining a blank comprising a plurality of panels, a plurality of end flaps foldably connected to the respective plurality of panels, and at least one gusset foldably connected to the at least one side panel and at least one end flap of the plurality of end flaps. The plurality of panels comprises a bottom panel, a top panel, and at least one side panel. The method also comprises folding the plurality of panels at least partially around an interior of the carton and forming at least one closed end of the carton so that the at least one gusset is foldably connected to the at least one side panel and the at least one closed end of the carton. The method also comprises expanding the interior of the carton by positioning the at least one gusset from a first position to a second position wherein the carton is expanded.

Other aspects, features, and details of the present disclosure can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The embodiments of the present disclosure described below generally relate to a carton suitable for storing and dispensing articles such as, for example, beverage containers. The carton provides a bottom receptacle suitable for accommodating, for example, ice, associated water runoff, liquids, or other cooling materials in the carton bottom. In one exemplary embodiment, ice can be added to the opened top of the carton to cool beverage containers held within the carton. As the ice melts, all or a part of the resultant runoff water may be held within the bottom receptacle.

Articles accommodated within the present carton embodiments can include containers such as, for example, metallic beverage cans, glass or plastic bottles, or other containers such as, for example, those used in packaging beverages, foodstuffs, and other products. For the purposes of illustration and not for the purpose of limiting the scope of the disclosure, the following detailed description describes generally cylindrical metallic beverage containers as disposed within the carton. In this specification, the terms "side," "end," "bottom," and "top" indicate orientations determined in relation to fully erected, upright cartons.

Figure 1:
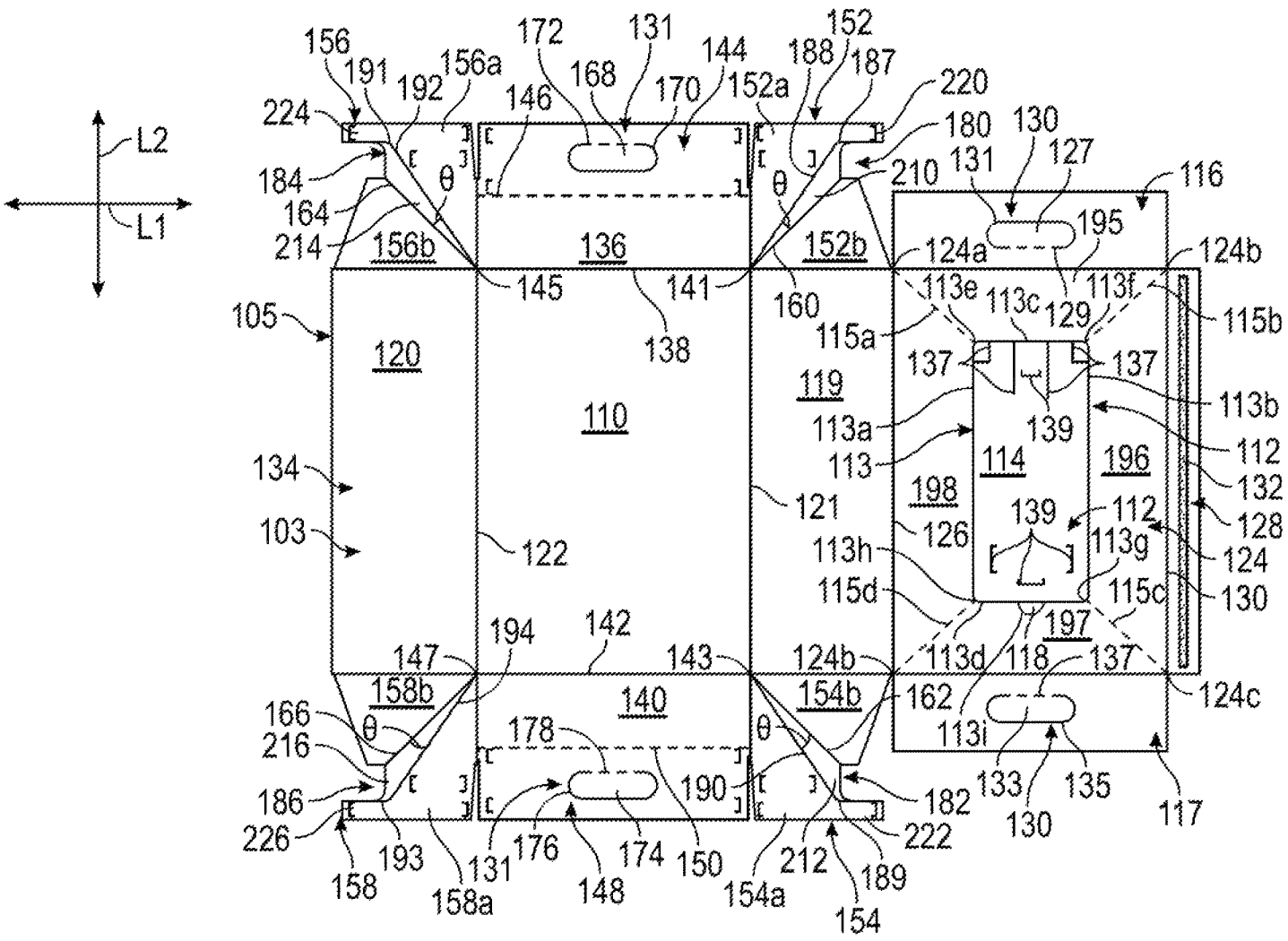
FIG. 1 is a plan view of a blank for forming a carton according to one exemplary embodiment of the disclosure.

FIG. 1 is a plan view of a blank 105 used to form a carton 107 (FIG. 6) according to one embodiment of the disclosure. The exterior or printed surface 103 of the blank 105 is shown in FIG. 1. The blank 105 has a longitudinal axis L1 extending along a length of the blank 105, and a lateral axis L2 extending along a width of the blank 105. As discussed in detail below, the carton 107 includes a bottom receptacle 111

(FIG. 8) that is for containing beverage containers C and which has substantially liquid-tight features for retaining liquid and minimizing, inhibiting, and/or preventing leakage of liquid from the carton 107. The carton 107 also has top access features 112 for allowing access to the containers C and features for expanding the volume of the carton 107 to allow ice I or other coolant to be placed on top of and surround the containers C retained in the carton 107. In the illustrated embodiment, the carton 107 is sized to house twenty four containers C in a single layer in a 4×6 arrangement, but it is understood that the carton 107 may be sized and shaped to hold containers of a different or same quantity in more than one layer and/or in different row/column arrangements (e.g., 1×6, 3×4, 2×6×2, 3×4×2, 3×5, 4×5, 3×6, 2×5, 2×6, 4×4, etc.).

As shown, the blank 105 comprises a bottom panel 110, a first side panel 119 foldably connected to the bottom panel 110 at a lateral fold line 121, and a second side panel 120 foldably connected to the bottom panel 110 at lateral fold line 122. A top panel 124 is foldably connected to the first side panel 119 at a lateral fold line 126, and an attachment flap 128 is foldably connected to the top panel 124 at a lateral fold line 130. Adhesive 132 may be applied to the attachment flap 128, as indicated in FIG. 1.

In one embodiment, as shown, a bottom end panel 136 is foldably connected to the bottom panel 110 at a longitudinal fold line 138 and a bottom end panel 140 is foldably connected to the bottom panel 110 at a longitudinal fold line 142. A closure flap 144 is foldably connected to a distal end of the bottom end panel 136 at a longitudinal fold line 146 and a closure flap 148 is foldably connected to a distal end of bottom end panel 140 at a longitudinal fold line 150. In this specification, the terms "end" and "side" are used for ease of reference, and do not imply relative sizes of the end panels 136, 140 and the side panels 119, 120, for example. The end panels 136, 140, closure flaps 144, 148 and fold lines 146, 150 could be otherwise shaped, arranged, and/or configured without departing from the disclosure. For example, fold lines 146, 150 could include more than one line of weakening, such as in a double fold line or to define a tear strip or the fold lines could be omitted without departing from the disclosure.

As illustrated in FIG. 1, gussets 152, 154, 156, 158 are located at respective corners 141, 143, 145, 147 of the bottom panel 110. Gusset 152 is located at the corner 141 of the bottom panel 110 and extends between and is connected to the side panel 119 and the bottom end panel 136. Gusset 154 is located at the corner 143 of the bottom panel 110 and extends between and is connected to the side panel 119 and the bottom end panel 140. Gusset 156 is located at the corner 145 of the bottom panel 110 and extends between and is connected to the side panel 120 and the bottom end panel 136. Gusset 158 is located at the corner 147 of the bottom panel 110 and extends between and is connected to the side panel 120 and the bottom end panel 140.

Figure 6:
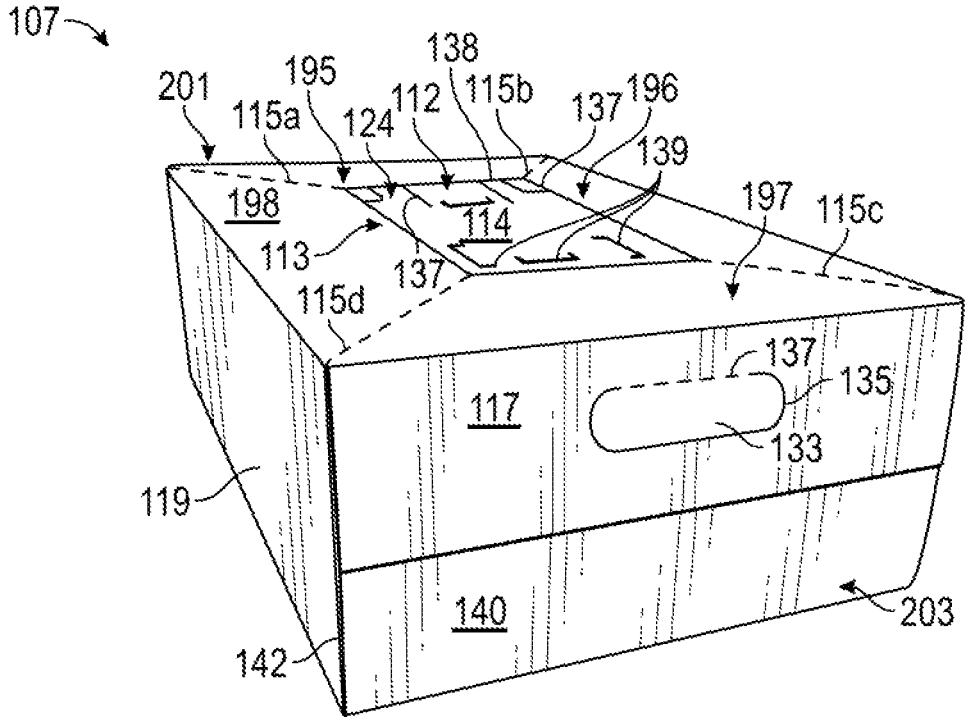
FIG. 6 is a perspective view of a carton formed from the blank of FIG. 1.

As shown in FIG. 1, the blank 105 includes top end flaps 116, 117 respectively foldably connected to the top panel 124 at portions of respective longitudinal fold lines 138, 142. In one embodiment, as shown, the handle features 130 can be formed at the top end flaps 116, 117 for holding and carrying the carton 107 (FIG. 6). The handle features 130 at the top end flap 116 can include a handle flap 127 defined by a cut or tear line 131 and foldably connected to the top end flap 116 along a longitudinal fold line 129. The handle features 130 at the top end flap 117 can include a handle flap 133 defined by a cut or tear line 135 and foldably connected to the top end flap 117 along a longitudinal fold line 137. In one embodiment, the top end flap 116, the bottom end panel 136, the closure flap 144, and the gussets 152, 156 extend along a first marginal portion of the blank 105 and are for being positioned to close a first end 201 of the carton 107 (FIG. 6). The top end flap 117, the bottom end panel 140, the closure flap 148, and the gussets 154, 158 extend along a second marginal portion of the blank 105 and are for being positioned to close a second end 203 of the carton 107. The blank 105 could have other features for closing the ends 201, 203 of the carton 107 without departing from the disclosure.

In one embodiment, as shown, the handle features 131 can be formed at the closure flaps 144, 148 and generally correspond and align with the handle features 130 in the respective top end flaps 116, 117. The handle features 131 at the closure flap 144 can include a handle flap 168 defined by a cut 170 and foldably connected to the closure flap 144 along a longitudinal fold line 172. The handle features 131 at the closure flap 148 can include a handle flap 174 defined by a cut 176 and foldably connected to the closure flap 148 along a longitudinal fold line 178. The handle features 131 in the closure flaps 144, 148 could be otherwise shaped, arranged, configured, or omitted without departing from the disclosure.

In one embodiment, as shown, the top access features 112 in the top panel 124 may include a tear line 113 or other breachable line of disruption extending generally around and defining a dispenser panel 114 in the top panel 124. As illustrated in FIG. 1, the dispenser panel 114 can include a plurality of score lines 137 and cuts 139 which may provide locations for engagement by a user and/or may provide for relative movement of the dispenser panel 114 during use of the carton 107 (FIG. 6). The tear line 113 is generally rectangular and includes lateral portions 113*a*, 113*b* connected by longitudinal portions 113*c*, 113*d*, as shown, to form corners 113*e*, 113*f*, 113*g*, 113*h* of the tear line 113. An arcuate portion 113*i* of the tear line 113 extends from a longitudinal portion 113*d* of the tear line 113 to define an access flap 118. Oblique tear lines 115*a*, 115*b*, 115*c*, 115*d* extend from the respective corners 113*e*, 113*f*, 113*g*, 113*h* of the tear line 113 to respective corners 124*a*, 124*b*, 124*c*, 124*d* of the top panel 124 and define four top access flaps 195, 196, 197, 198 in the top panel 124. As shown in FIG. 1, the top access flap 195 is foldably connected to the top end flap 116 at a portion of the longitudinal fold line 138. The top access flap 196 is foldably connected to the adhesive flap 128 at the lateral fold line 130. The top access flap 197 is foldably connected to the top end flap 117 at a portion of the longitudinal fold line 142. The top access flap 198 is foldably connected to the side panel 119 at lateral fold line 126. The top access features 112 include at least the dispenser panel 114, the top panel 124, and the top access flaps 195, 196, 197, 198. The top access features 112 could have other features and/or be otherwise shaped, arranged, and/or configured without departing from the disclosure. For example, the dispenser panel 114 could be arcuate and free from score lines and cuts without departing from the disclosure.

As shown, each gusset 152, 154 comprises a respective first gusset panel 152*a*, 154*a* foldably connected to a respective adjacent bottom end panel 136, 140 at a portion of the lateral fold line 121 and each gusset 156, 158 comprises a respective first gusset panel 156*a*, 158*a* foldably connected to a respective adjacent bottom end panel 136, 140 at the longitudinal fold line 122. Each gusset 152, 154, 156, 158 includes a respective second gusset panel 152*b*, 156*b* and 154*b*, 158*b* foldably connected to a respective side panel 119, 120 at a portion of the respective lateral fold lines 138, 142. The second gusset panels 152*b*, 154*b*, 156*b*, 158*b* are foldably connected to a respective first gusset panel 152*a*, 154*a*, 156*a*, 158*a* at a respective oblique fold line 188, 190, 192, 194. In the illustrated exemplary embodiment, each of the gussets 152, 154, 156, 158 may comprise a notch 180, 182, 184, 186 generally shaped to correspond to, e.g., align with, the handle features 131 in the respective closure flaps 144, 148 so that, upon alignment with the handle features 131, the notches 180, 182, 184, 186 at least partially surround the handle features 131, as described further herein. In embodiments, the notches 180, 182, 184, 186 may be cutouts or other indentations. As shown, the gusset panels 152*b*, 154*b*, 156*b*, 158*b* include the respective oblique fold lines 188, 190, 192, 194 extending from the respective corners 141, 143, 145, 147 of the bottom panel 110 to generally the upper portion of the notches 180, 182, 184, 186. In one embodiment, the oblique score lines 188, 190, 192, 194 are offset an angle "θ" from the oblique fold lines 160, 162, 164, 166 in the respective second gusset panels 152*b*, 154*b*, 156*b*, 158*b*. The angle "θ" may range from about 1 to about 30 degrees. In one embodiment, as shown, each of the second gusset panels 152*b*, 154*b*, 156*b*, 158*b* includes a respective expansion panel 210, 212, 214, 216 foldably connected therealong that may be generally triangular-shaped, as shown. In this regard, the second gusset panels 152*b*, 154*b*, 156*b*, 158*b* are larger than the respective first gusset panels, 152*a*, 154*a*, 156*a*, 158*a*, as shown. The expansion panel 210 is in the gusset 152 and is defined between the two oblique fold lines 160, 188. The expansion panel 212 is in the gusset 154 and is defined between the two oblique fold lines 162, 190. The expansion panel 214 is in the gusset 156 and is defined between the two oblique fold lines 164, 192. The expansion panel 216 is in the gusset 158 and is defined between the two oblique fold lines 166, 194. In the illustrated embodiment, the oblique fold lines 188, 190, 192, 194 include respective curved end portions 187, 189, 191, 193 that are spaced inward from an edge of a respective notch 180, 182, 184, 186 of the blank 105. In one embodiment, each of the first gusset panels 152*a*, 154*a*, 156*a*, 158*a* includes an attachment tab 220, 222, 224, 226 at least partially extending adjacent a respective notch 180, 182, 184, 186. The gussets 152, 154, 156, 158 and the various features of the gussets may be otherwise shaped, arranged, and/or configured, or one or more of the various features could be omitted, without departing from the disclosure.

An exemplary method of erecting the carton 107 from the blank 105 is discussed below with additional reference to FIGS. 2-6. The carton 107 can be erected with other methods or folding steps without departing from the disclosure.

Figure 2:
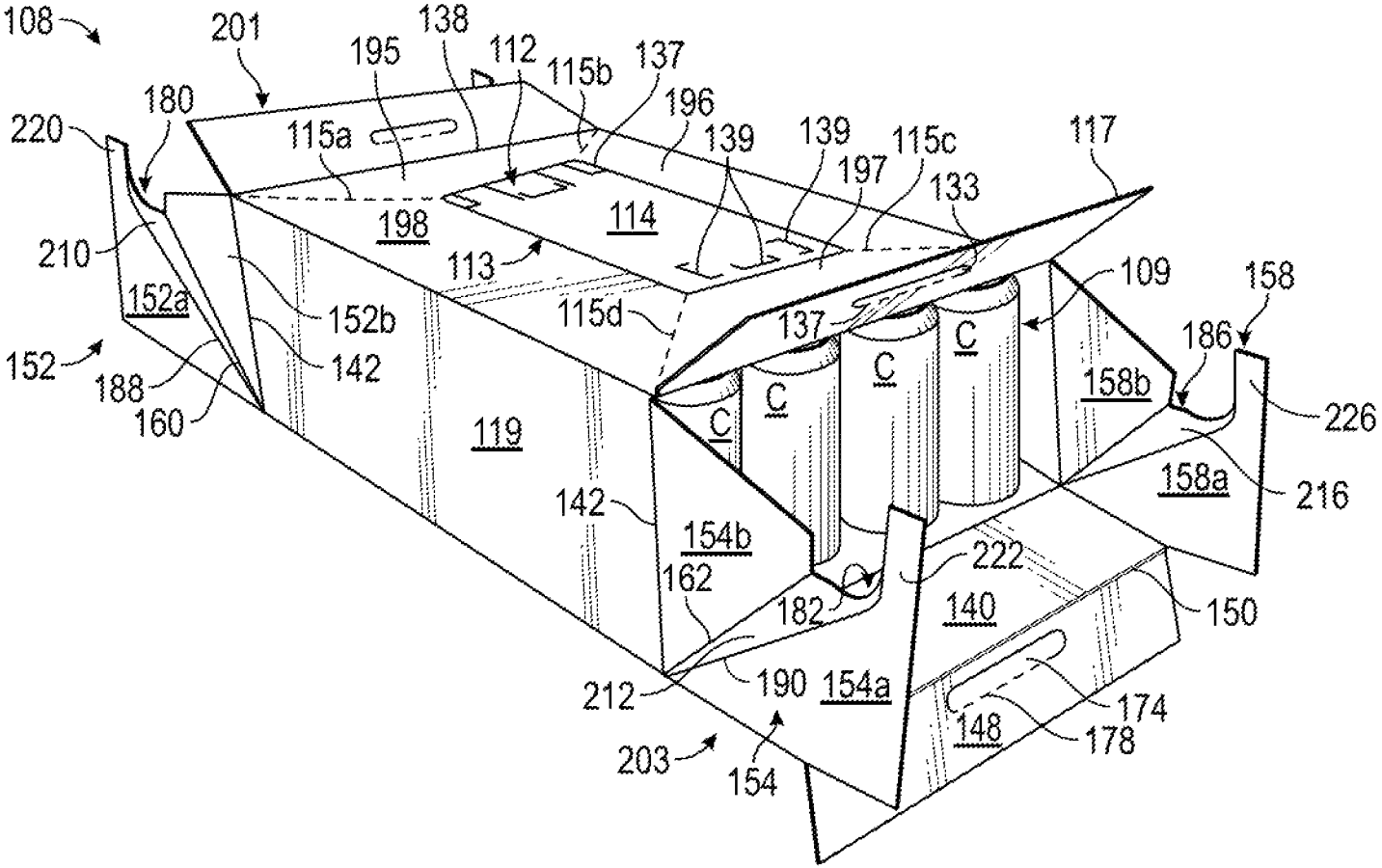
FIG. 2 is a first sequential perspective view of a folding of the blank of FIG. 1.
Figure 3:
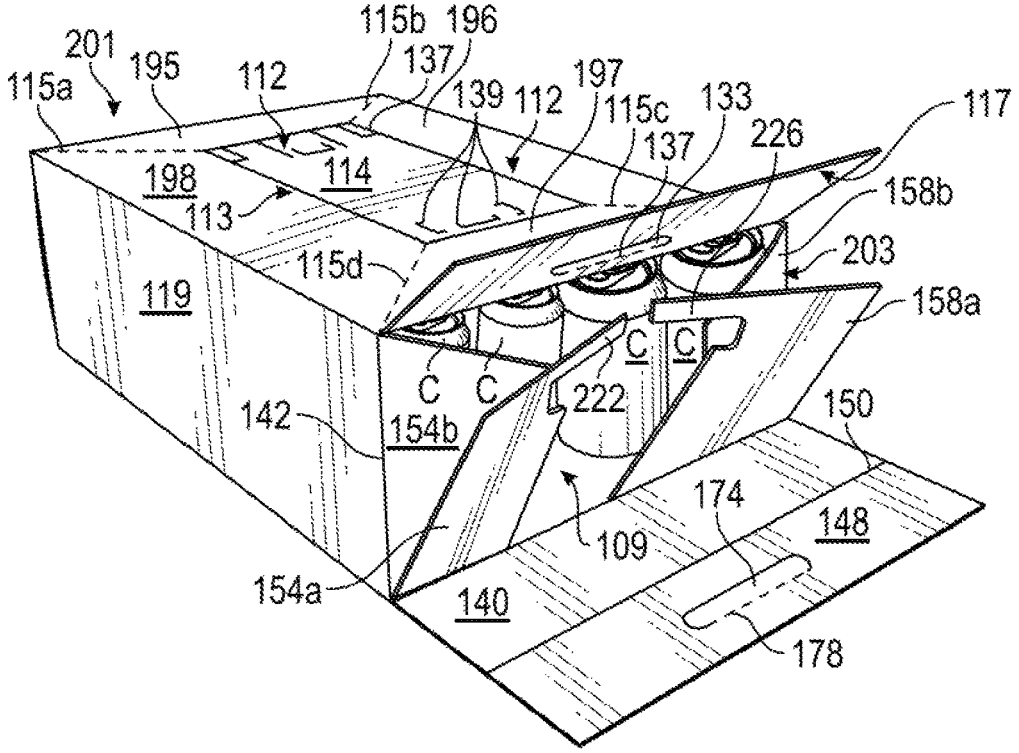
FIG. 3 is a second sequential perspective view of a folding of the blank of FIG. 1.
Figure 4:
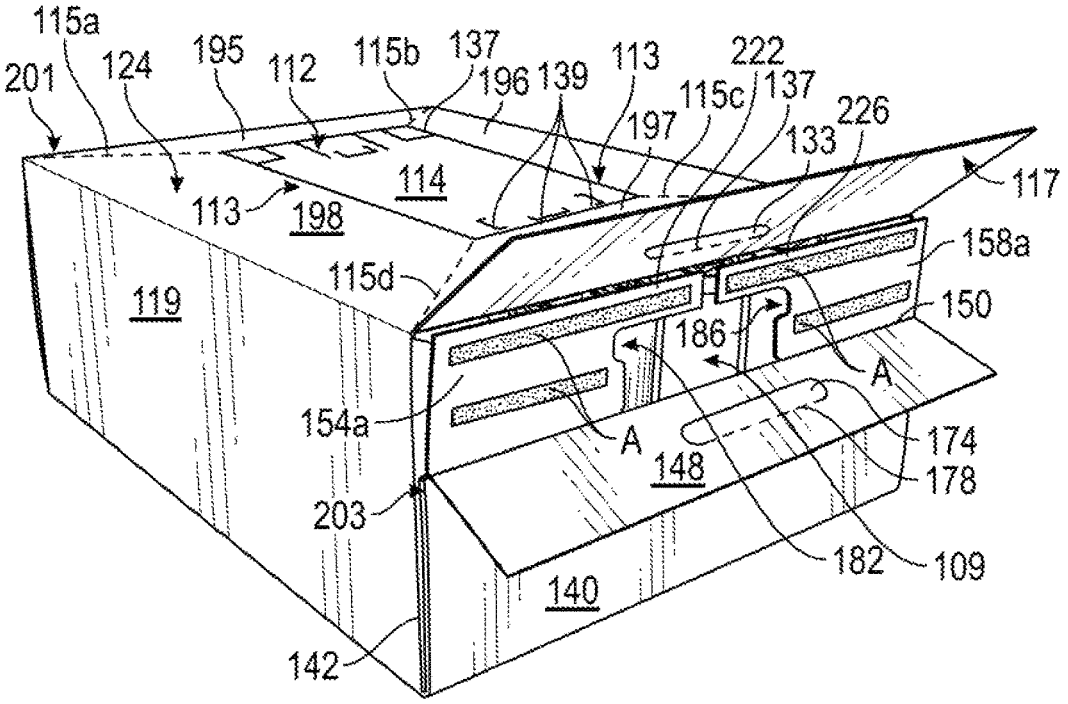
FIG. 4 is a third sequential perspective view of a folding of the blank of FIG. 1.
Figure 5:
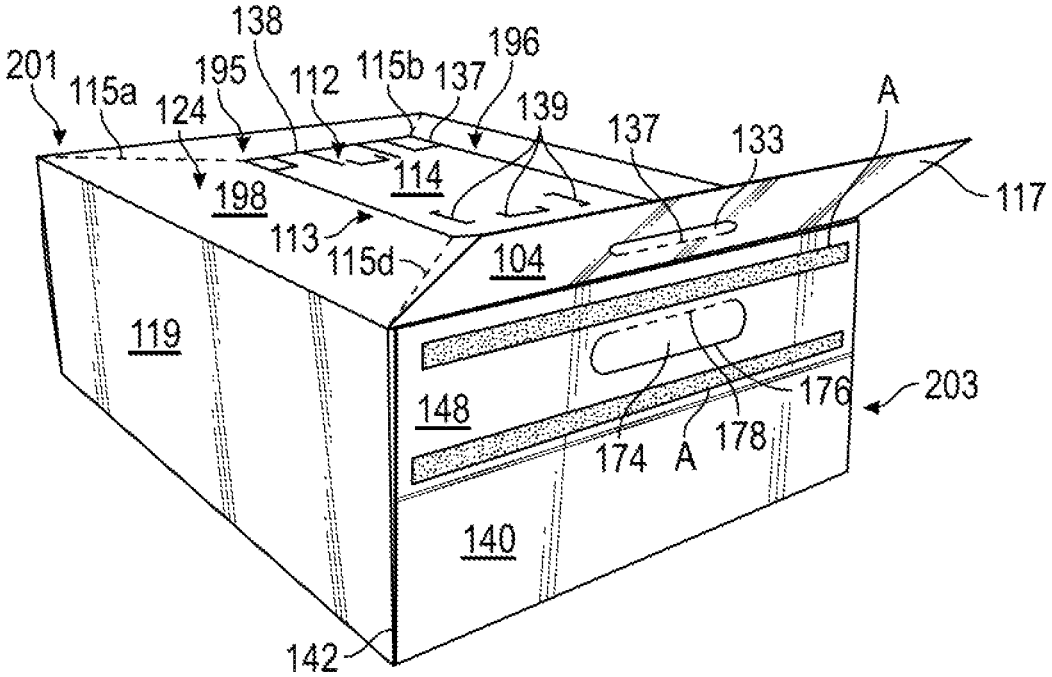
FIG. 5 is a fourth sequential perspective view of a folding of the blank of FIG. 1.

In one embodiment, the blank 105 is positioned with the exterior side 103 facing down, and the blank 105 is then folded along fold lines 122, 126 and the attachment flap 128 is positioned in face-to-face contact with the second side panel 120. The exterior surface of the attachment flap 128 is adhered to the interior surface of the second side panel 120 with the adhesive 132. The partially erected blank 105 may then be opened up into a sleeve 108 having open ends or another generally tubular form such that an interior 109 is formed. The interior 109 will form the interior of the carton 107 upon closing the ends 201, 203 of the carton 107, as described herein. The carton 107 may be filled with articles such as, for example, generally cylindrical beverage containers C, as shown in FIG. 2, before closing one or both ends 201, 203 of the carton 107, as described further herein. As illustrated in FIG. 3, from the open-ended sleeve 108 form, the first and second gusset panels 152*a*, 154*a*, 156*a*, 158*a* and 152*b*, 154*b*, 156*b*, 158*b* are folded inwardly with respect to each other about the oblique fold lines 160, 162, 164, 166. As shown in FIG. 4, the closure flaps 144, 148 are folded about respective fold lines 146, 150 and adhesive A can be added to the interior of the gusset panels 152*a*, 154*a*, 156*a*, 158*a*. The expansion panels 210, 212, 214, 216 remain free from adhesive A as they are overlapped by the respective first gusset panels 152*a*, 154*a*, 156*a*, 158*a*. The closure flaps 144, 148 can then be adhesively secured to the gusset panels 152*a*, 154*a*, 156*a*, 158*a* by raising the closure flaps 144, 148 into face-to face contact with portions of the gusset panels 152*a*, 154*a*, 156*a*, 158*a*, as shown in FIG. 5. As shown in FIGS. 5 and 6, adhesive A can be added to the exterior of the closure flaps 144, 148 and the top end flaps 116, 117 can be downwardly folded and positioned in face-to-face contact with the closure flaps 144, 148 to form the carton 107 having closed ends 201, 203. The ends 201, 203 of the carton 107 can be closed by other features or forming steps without departing from the disclosure.

In the illustrated embodiment, the carton 107 is loaded with twenty-four generally cylindrical twelve-ounce beverage containers C (FIG. 2) disposed in a 4×6×1 configuration. Embodiments with alternative configurations are considered within the scope of the present disclosure. The carton 107 has a generally parallelepipedal shape. At a respective ends 201, 203 of the carton 107, the end flaps 116, 117 overlap the closure flaps 144, 148. Each of the bottom end panels 136, 140, the side panels 119, 120, and the gussets 152, 154, 156, 158 cooperate to form a substantially liquid-tight bottom receptacle 111, as described further herein.

Figure 7:
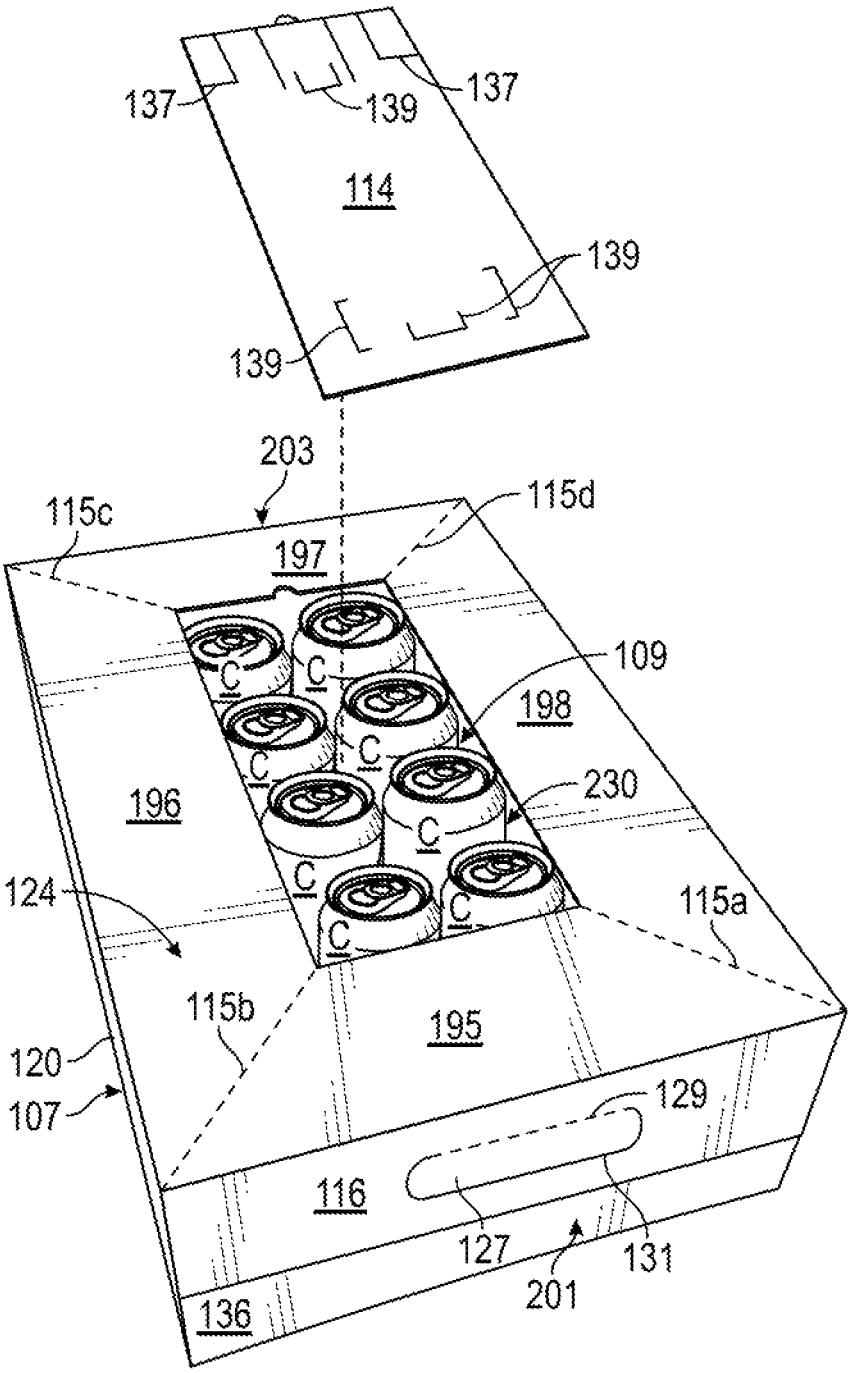
FIG. 7 is a perspective view of the carton of FIG. 6 with a top access panel removed.
Figure 8:
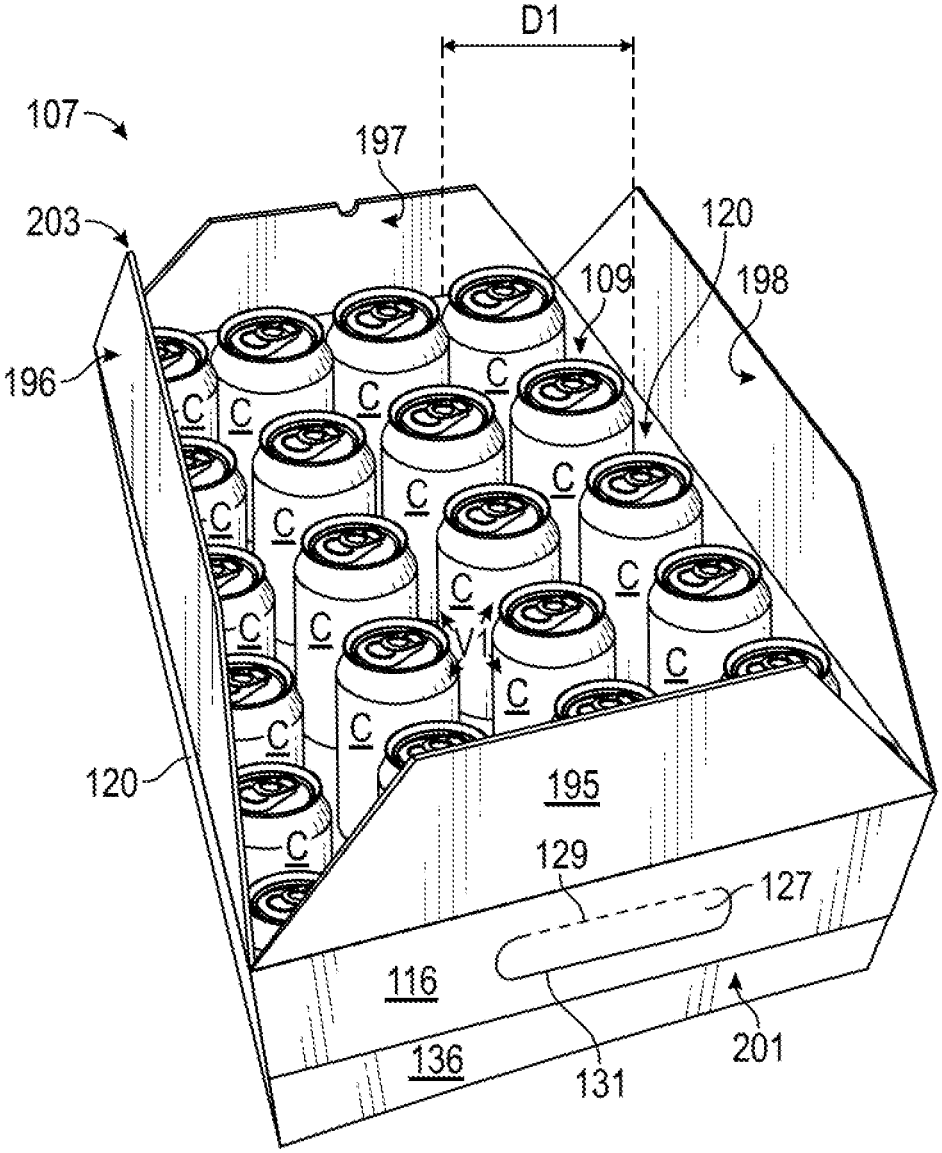
FIG. 8 is a perspective view of the carton of FIG. 6 with a plurality of access flaps being activated.

Referring to FIGS. 1, 7, and 8, the access or dispensing features 112 of the carton 107 are activated by tearing the tear line 113 to remove the dispenser panel 114 to create a dispenser opening 230 through which one or more containers C in the interior 109 of the carton 107 can be accessed, as illustrated in FIG. 7. Removal of the dispenser panel 114 may include breaching the tear line 113*i* about the access flap 118 such that the access flap 118 can be pushed toward the interior 109 of the carton 107 to allow for engagement of the remainder of the dispenser panel 114 by a user. The top access flaps 195, 196, 197, 198 can be separated by tearing the top panel 124 along tear lines 115*a*, 115*b*, 115*c*, and 115*d*. The separated top access flaps 195, 196, 197, 198 are folded upwardly about respective fold lines 138, 130, 142, 126 to expand the dispensing opening 230 and provide access to the interior 109 of the carton 107. In the illustrated configuration, the bottom receptacle 111 of the carton 107 has a first volume V1 that is reconfigurable to a different volume through manipulation of portions of the carton 107, as described further herein.

Figure 9:
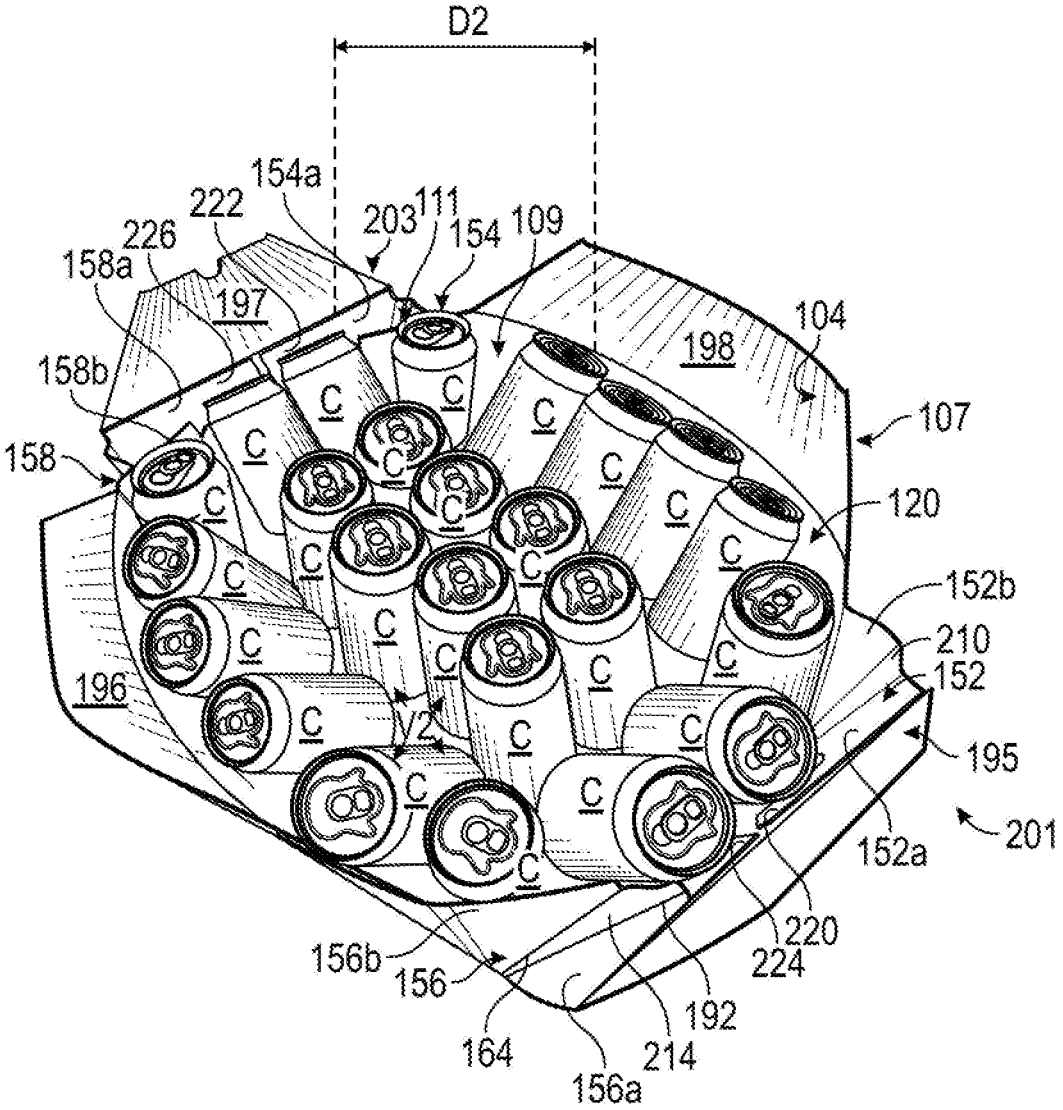
FIG. 9 is a perspective view of the carton of FIG. 6 in a first, unexpanded configuration.
Figure 10:
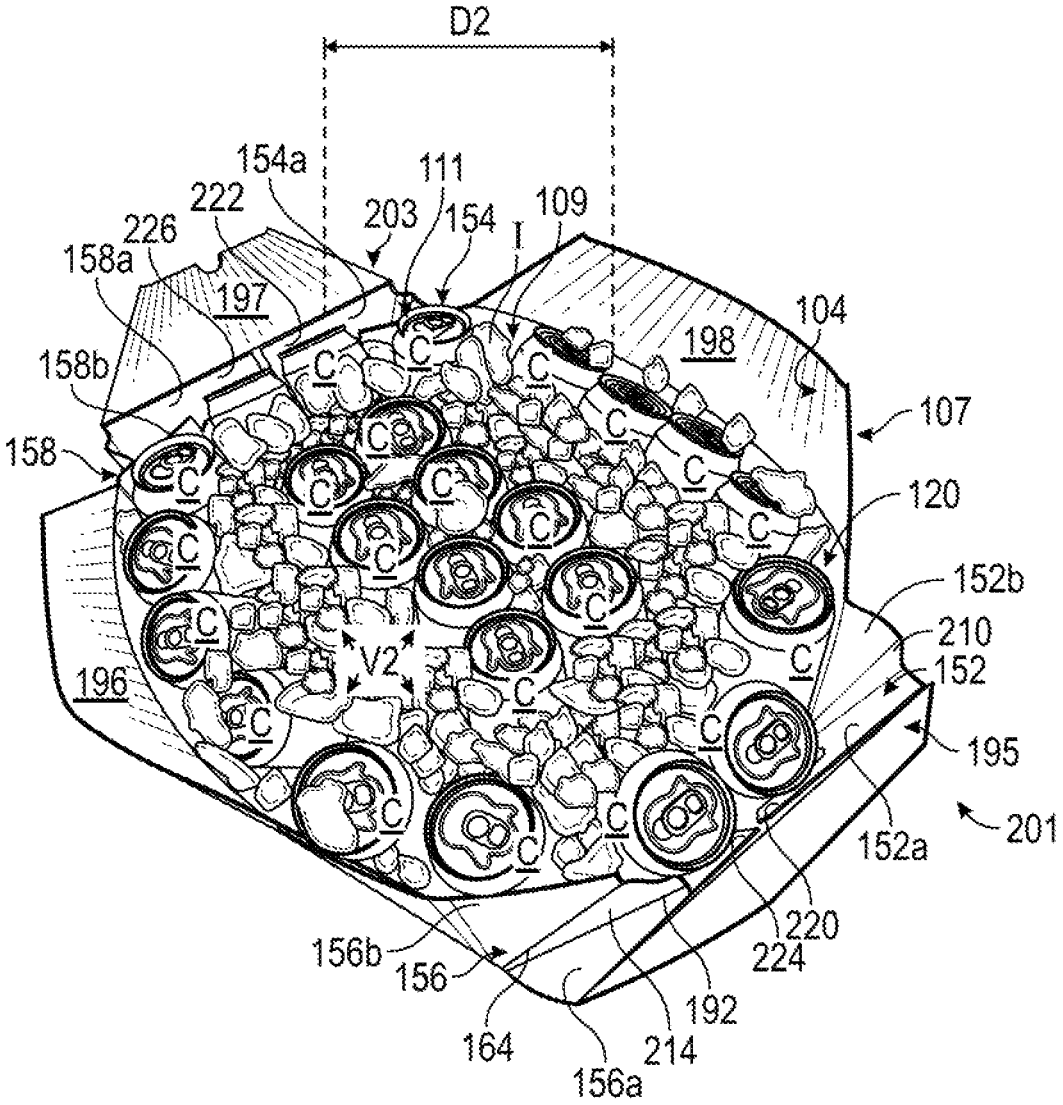
FIG. 10 is a perspective view of the carton of FIG. 6 in a second configuration.

Referring to FIGS. 1, 9, and 10, once the top access feature 112 is opened, the bottom receptacle 111 is capable of receiving ice I or other cooling material that can be placed on top of and/or around the containers C. In embodiments, the top access flaps 195, 196, 197, 198 may be used to guide ice I or other cooling material into the interior 109 of the carton 107. However, additional space within the bottom receptacle 111 of the carton 107 may be desired for accommodating ice I or other cooling material. In this regard, the carton 107 is configured for expansion to allow additional room for ice I or other cooling material to be placed on top of and around the containers C. To facilitate such expansion, the side panels 119, 120 and end panels 136, 140 flex outwardly from the interior 109 of the carton 107, as shown. Such relative movement of the panels 119, 120, 136, 140 is facilitated by unfolding of the gussets 152, 154, 156, 158. In particular, and as shown, when the end panels 136, 140 at each end 201, 203 of the carton 107 are expanded, each expansion panel 210, 212, 214, 216 is pulled away from a respective end panel 136, 140 to expand each end 201, 203 of the carton 107 such that a distance D2 between selected points on one of the first side panel 119 and the second side panel 120 and an adjacent end 201, 203 of the carton 107 is greater than a distance D1 (FIG. 8) between the same points when the carton 107 is in the unexpanded configuration. Accordingly, the second gusset panels 152*b*, 154*b*, 156*b*, 158*b*, which include respective expansion panels 210, 212, 214, 216, can be transitioned from a first, folded configuration against respective first gusset panels, 152*a*, 154*a*, 156*a*, 158*a* (shown best in FIG. 8) to a second, unfolded configuration in which the second gusset panels 152*b*, 154*b*, 156*b*, 158*b* are folded away from the respective first gusset panels 152*a*, 154*a*, 156*a*, 158*a* (shown best in FIGS. 9 and 10).

Such unfolding of the gussets 152, 154, 156, 158 occurs as the first gusset panels 152*a*, 156*a* and 154*a*, 158*a* are adhered to respective end panels 136, 140, and the second gusset panels 152*b*, 156*b*, 154*b*, 158*b* are free to unfold relative to the respective first gusset panels 152*a*, 156*a*, 154*a*, 158*a*. Accordingly, the expansion panels 210, 214 and 212, 216 are free from adhesive connection to a respective end panel 136, 140 while the portion of the gusset panels 152*a*, 156*a* and 154*a*, 158*a* adjacent a respective expansion panel 210, 214 and 212, 216 is adhesively attached to a respective end panel 136, 140. As such, the expansion panels 210, 212, 214, 216 allow each gusset 152, 154, 156, 158 to expand and to increase separation between the second gusset panels 152*b*, 156*b* and 154*b*, 158*b* and the respective end panels 136, 140 while maintaining the substantially liquid-tight configuration of the bottom receptacle 111. The tabs 220, 222, 224, 226 of the gussets 152, 154, 156, 158 allow secure attachment of the first gusset panels 152*a*, 156*a* and 154*a*, 158*a* to the respective end panels 136, 140.

In this regard, the volume V1 of the bottom receptacle 111 can be increased by the expansion of the gussets 152, 154, 156, 158 and the flexing of the side panels 119, 120 to a greater volume V2 (shown best in FIGS. 9 and 10) that can accommodate a greater amount of ice I or other cooling material. The carton 107 may be assembled such that the bottom receptacle 111 is substantially liquid-tight to keep the ice I or other cooling material and associated runoff such as water from escaping from the carton 107 to maintain a desired temperature of the containers C. In the expanded configuration shown in FIGS. 9 and 10, containers C disposed in the bottom receptacle 111 can be accessed and withdrawn from the carton 107 as in the unexpanded configuration.

According to one aspect of the present disclosure, if desired, additional articles may be placed in the carton 107 after opening. As the ice I melts, the carton 107 serves to retain all or a portion of the water runoff from the melting ice due to the substantially liquid-tight configuration of the bottom receptacle 111.

The lower gusset panels 152*b*, 154*b*, 156*b*, 158*b* and expansion panels 210, 212, 214, 216 may define in part the at least partially liquid-tight bottom receptacle 111 in the erected carton 107. The height of the top edge or upper border of the gusset panels 152*b*, 154*b*, 156*b*, 158*b* may represent a portion of the carton 107 below which no glued seals or seams are formed through which water or other liquid might leak. That is, no adhesive seal or other joinder of material where fluid might escape the carton 107 is located in the carton 107 at a position below the top edge of the bottom receptacle 111. The bottom receptacle 111 may therefore be formed from a continuous portion of folded material of the blank 105. The dimensions of the bottom receptacle 111 may be increased or decreased, for example, to accommodate larger or smaller anticipated liquid volumes in the carton 107.

The blank 105 can, for example, be constructed of fluid-resistant material to any degree desired so that liquid in the carton 107 remains in the carton 107 for a selected amount of time.

Cartons according to the principles of the present disclosure may be formed from materials such as, for example, paperboard. Therefore, if exposed to water or other liquids for extended periods of time, the carton may allow for the passage of liquid through the wetted carton surfaces due to partial permeability of the carton material. In this specification, the term "liquid-tight" is generally used to define a portion of a carton that is formed from a continuous portion of material or of a portion without any glued seams through which liquid or fine particulate matter might leak, and the term "liquid-tight" therefore encompasses cartons that may become partially water permeable over time due to prolonged exposure to water or other liquids.

In the above embodiments, the cartons are described as accommodating twenty four 12-ounce cans containers in 4×6×1 configuration. Other arrangements of containers, packages, articles, and other items, however, can be accommodated within a carton constructed according to the principles of the present disclosure. For example, a carton constructed according to the principles of the present disclosure would also work satisfactorily if the carton were sized and shaped to hold articles in other configurations, such as 3×4×1, 3×6×1, 2×4×1, 2×5×1, 2×6×1, etc., and multi-tier variations of the aforementioned configurations.

The dimensions of the blanks may also be altered, for example, to accommodate various container forms. For example, bottles having any shape, may be accommodated within a carton constructed according to the principles of the present disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper (e.g., a caliper of at least about 14). The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

The above embodiments may be described as having one or more panels adhered together by glue. The terms "glue" and "adhesive" are intended to encompass all manner of adhesives commonly used to secure carton panels in place.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In the present specification, a "panel" or "flap" need not be flat or otherwise planar. A "panel" or "flap" can, for example, comprise a plurality of interconnected generally flat or planar portions.

For purposes of the description presented herein, the term "line of disruption" can be used to generally refer to, for example, a cut line, a score line, a crease line, a tear line, or a fold line (or various sequential and/or overlapping combinations thereof) formed in a blank. A "breachable" line of disruption is a line of disruption that is intended to be breached during ordinary use of the carton. An example of a breachable line of disruption is a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous or substantially continuous slit, or the like. For example, a cut line can be a continuous slit or could be wider than a slit without departing from the present disclosure.

In the illustrated embodiments, selected fold lines are shown as including spaced cuts to facilitate folding along the lines. If the cuts are below or adjacent to a bottom receptacle portion of a carton, less than 100% cuts may be used to prevent leakage along the fold lines. Alternatively, cuts or scores may be omitted within or near the receptacle portion.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding one or more containers, comprising:

a plurality of panels that extend at least partially around an interior of the carton, the plurality of panels comprising a bottom panel, a top panel, and at least one side panel;

a plurality of end flaps foldably connected to the respective plurality of panels to form at least one closed end of the carton;

at least one gusset foldably connected between the at least one side panel and the at least one closed end of the carton, the at least one gusset comprising a first gusset panel foldably connected to a second gusset panel, the at least one gusset further comprising a tab extending from the first gusset panel to at least partially define a notch in the at least one gusset, the at least one gusset is positionable between a first position and a second position wherein the interior of the carton is expanded; and a handle feature in at least one end flap of the plurality of end flaps, wherein the notch aligns with the handle feature in the at least one closed end of the carton.

2. The carton of claim 1, wherein the first gusset panel is attached to at least one end flap of the plurality of end flaps at the at least one closed end of the carton, and the second gusset panel is movable relative to the first gusset panel.

3. The carton of claim 1, wherein the second gusset panel is larger than the first gusset panel.

4. The carton of claim 1, wherein, in the first position, the at least one side panel and the at least one closed end are spaced apart a first distance, and in the second position, the at least one side panel and the at least one closed end are spaced apart a second distance that is larger than the first distance.

5. The carton of claim 1, wherein in the first position, the interior of the carton has a first volume, and in the second position, the interior of the carton has a second volume that is larger than the first volume.

6. The carton of claim 1, wherein the at least one side panel comprises a first side panel and a second side panel, the at least one closed end of the carton comprises a first closed end and second closed end, the at least one gusset comprises a first gusset foldably connected to the first side panel and the first closed end, a second gusset foldably connected to the second side panel and the first closed end, a third gusset foldably connected to the first side panel and the second closed end, and a fourth gusset panel foldably connected to the second side panel and the second closed end.

7. The carton of claim 1, wherein at least one end flap of the plurality of end flaps, the at least one gusset, and the at least one side panel cooperate to form a bottom receptacle of the carton.

8. The carton of claim 7, wherein the bottom receptacle has a substantially liquid-tight configuration.

9. The carton of claim 1, wherein the second gusset panel comprises an expansion panel foldably connected to the first gusset panel.

10. The carton of claim 9, wherein the expansion panel further comprises a first oblique fold line foldably connecting the first gusset panel and the second gusset panel, the second gusset panel comprises a second oblique fold line, and the expansion panel is at least partially defined by the first oblique fold line and the second oblique fold line.

11. The carton of claim 10, wherein the angular distance between the first oblique fold line and the second oblique fold line is between about 1 degree and about 30 degrees.

12. The carton of claim 1, wherein the top panel comprises at least one access feature.

13. The carton of claim 12, wherein the at least one access feature comprises a plurality of access flaps foldably connected to the top panel, each access flap separable from an adjacent access flap along a respective tear line.

14. The carton of claim 13, wherein the at least one access feature comprises a dispenser panel separable from the top panel.

15. A blank for forming a carton for holding one or more containers, comprising:

a plurality of panels for folding at least partially around an interior of the carton when the carton is formed from the blank, the plurality of panels comprising a bottom panel, a top panel, and at least one side panel;

a plurality of end flaps foldably connected to the respective plurality of panels for folding to form at least one closed end of the carton when the carton is formed from the blank; and at least one gusset foldably connected between the at least one side panel and the at least one closed end of the carton when the carton is formed from the blank, the at least one gusset comprises a first gusset panel foldably connected to a second gusset panel, the at least one gusset further comprises a tab extending from the first gusset panel to at least partially define a notch in the at least one gusset, the at least one gusset is positionable between a first position and a second position wherein the interior of the carton is expanded; and a handle feature in at least one end flap of the plurality of end flaps, and wherein the notch aligns with the handle feature in the at least one closed end of the carton when the carton is formed from the blank.

16. The blank of claim 15, wherein the first gusset panel is for attachment to at least one end flap of the plurality of end flaps at the at least one closed end of the carton when the carton is formed from the blank, and the second gusset panel is movable relative to the first gusset panel.

17. The blank of claim 15, wherein the second gusset panel is larger than the first gusset panel.

18. The blank of claim 15, wherein, when the carton is formed from the blank, in the first position, the at least one side panel and the at least one closed end are spaced apart a first distance, and in the second position, the at least one side panel and the at least one closed end are spaced apart a second distance that is larger than the first distance.

19. The blank of claim 15, wherein, when the carton is formed from the blank, in the first position, the interior of the carton has a first volume, and in the second position, the interior of the carton has a second volume that is larger than the first volume.

20. The blank of claim 15, wherein the at least one side panel comprises a first side panel and a second side panel, the at least one closed end of the carton comprises a first closed end and second closed end when the carton is formed from the blank, the at least one gusset comprises a first gusset foldably connected to the first side panel and the first closed end when the carton is formed from the blank, a second gusset foldably connected to the second side panel and the first closed end when the carton is formed from the blank, a third gusset foldably connected to the first side panel and the second closed end when the carton is formed from the blank, and a fourth gusset panel foldably connected to the second side panel and the second closed end when the carton is formed from the blank.

21. The blank of claim 15, wherein at least one end flap of the plurality of end flaps, the at least one gusset, and the at least one side panel are for cooperating to form a bottom receptacle of the carton when the carton is formed from the blank.

22. The blank of claim 21, wherein the bottom receptacle has a substantially liquid-tight configuration.

23. The blank of claim 15, wherein the second gusset panel comprises an expansion panel foldably connected to the first gusset panel.

24. The blank of claim 23, wherein the expansion panel further comprises a first oblique fold line foldably connecting the first gusset panel and the second gusset panel, the second gusset panel comprises a second oblique fold line, and the expansion panel is at least partially defined by the first oblique fold line and the second oblique fold line.

25. The blank of claim 24, wherein the angular distance between the first oblique fold line and the second oblique fold line is between about 1 degree and about 30 degrees.

26. The blank of claim 15, wherein the top panel comprises at least one access feature.

27. The blank of claim 26, wherein the at least one access feature comprises a plurality of access flaps foldably connected to the top panel, each access flap separable from an adjacent access flap along a respective tear line.

28. The blank of claim 27, wherein the at least one access feature comprises a dispenser panel separable from the top panel.

29. A method of forming a carton for holding one or more containers, comprising:

obtaining a blank comprising a plurality of panels comprising a bottom panel, a top panel, and at least one side panel, a plurality of end flaps foldably connected to the respective plurality of panels, and at least one gusset foldably connected to the at least one side panel and at least one end flap of the plurality of end flaps, and a handle feature in at least one end flap of the plurality of end flaps, the at least one gusset comprises a first gusset panel foldably connected to a second gusset panel, the at least one gusset further comprises a tab extending from the first gusset panel to at least partially define a notch in the at least one gusset;

folding the plurality of panels at least partially around an interior of the carton and forming at least one closed end of the carton so that the at least one gusset is foldably connected to the at least one side panel and the at least one closed end of the carton and so that the notch aligns with the handle feature in the at least one closed end of the carton; and expanding the interior of the carton by positioning the at least one gusset from a first position to a second position wherein the carton is expanded.

30. The method of claim 29, wherein the first gusset panel is attached to at least one end flap of the plurality of end flaps when the plurality of panels are folded, and the second gusset panel is movable relative to the first gusset panel.

31. The method of claim 29, wherein the second gusset panel is larger than the first gusset panel.

32. The method of claim 29, wherein, in the first position, the at least one side panel and the at least one closed end are spaced apart a first distance, and in the second position, the at least one side panel and the at least one closed end are spaced apart a second distance that is larger than the first distance.

33. The method of claim 29, wherein, in the first position, the interior of the carton has a first volume, and in the second position, the interior of the carton has a second volume that is larger than the first volume.

34. The method of claim 29, wherein the at least one side panel comprises a first side panel and a second side panel, the at least one closed end of the carton comprises a first closed end and second closed end when the plurality of panels are folded, the at least one gusset comprises a first gusset foldably connected to the first side panel and the first closed end when the plurality of panels are folded, a second gusset foldably connected to the second side panel and the first closed end when the plurality of panels are folded, a third gusset foldably connected to the first side panel and the second closed end when the plurality of panels are folded, and a fourth gusset panel foldably connected to the second side panel and the second closed end when the plurality of panels are folded.

35. The method of claim 29, wherein at least one end flap of the plurality of end flaps, the at least one gusset, and the at least one side panel form a bottom receptacle of the carton when the plurality of panels are folded.

36. The method of claim 35, wherein the bottom receptacle has a substantially liquid-tight configuration.

37. The method of claim 29, wherein the second gusset panel comprises an expansion panel foldably connected to the first gusset panel.

38. The method of claim 37, wherein the expansion panel further comprises a first oblique fold line foldably connecting the first gusset panel and the second gusset panel, the second gusset panel comprises a second oblique fold line, and the expansion panel is at least partially defined by the first oblique fold line and the second oblique fold line.

39. The method of claim 38, wherein the angular distance between the first oblique fold line and the second oblique fold line is between about 1 degree and about 30 degrees.

40. The method of claim 29, wherein the top panel comprises at least one access feature.

41. The method of claim 40, wherein the at least one access feature comprises a plurality of access flaps foldably connected to the top panel, each access flap separable from an adjacent access flap along a respective tear line.

42. The method of claim 41, wherein the at least one access feature comprises a dispenser panel separable from the top panel.

43. A carton for holding one or more containers, the carton comprising:

a plurality of panels that extends at least partially around an interior of the carton, the plurality of panels comprising a bottom panel, a top panel, and at least one side panel;

a plurality of end flaps foldably connected to the respective plurality of panels to form at least one closed end of the carton; and at least one gusset foldably connected between the at least one side panel and the at least one closed end of the carton, the at least one gusset comprising a first gusset panel foldably connected to a second gusset panel at a first oblique fold line and an expansion panel foldably connected to the second gusset panel at a second oblique fold line, the at least one gusset further comprising a notch at least partially defined by a free edge of the expansion panel, the free edge extends between the first oblique fold line and the second oblique fold line, the at least one gusset is positionable between a first position and a second position wherein the interior of the carton is expanded.

44. The carton of claim 43, further comprising a handle feature in at least one end flap of the plurality of end flaps, the notch aligns with the handle feature in the at least one closed end of the carton.

45. A blank for forming a carton for holding one or more containers, the blank comprising:

a plurality of panels for folding at least partially around an interior of the carton when the carton is formed from the blank, the plurality of panels comprising a bottom panel, a top panel, and at least one side panel;

a plurality of end flaps foldably connected to the respective plurality of panels for folding to form at least one closed end of the carton when the carton is formed from the blank; and at least one gusset foldably connected between the at least one side panel and the at least one closed end of the carton when the carton is formed from the blank, the at least one gusset comprises a first gusset panel foldably connected to a second gusset panel at a first oblique fold line and an expansion panel foldably connected to the second gusset panel at a second oblique fold line, the at least one gusset further comprising a notch at least partially defined by a free edge of the expansion panel, the free edge extends between the first oblique fold line and the second oblique fold line, the at least one gusset is positionable between a first position and a second position wherein the interior of the carton is expanded; and a handle feature in at least one end flap of the plurality of end flaps, and wherein the notch aligns with the handle feature in the at least one closed end of the carton when the carton is formed from the blank.

46. The blank of claim 45, further comprising a handle feature in at least one end flap of the plurality of end flaps, and wherein the notch aligns with the handle feature in the at least one closed end of the carton when the carton is formed from the blank.

47. A method of forming a carton for holding one or more containers, the method comprising:

obtaining a blank comprising a plurality of panels comprising a bottom panel, a top panel, and at least one side panel, a plurality of end flaps foldably connected to the respective plurality of panels, and at least one gusset foldably connected to the at least one side panel and at least one end flap of the plurality of end flaps, the at least one gusset comprises a first gusset panel foldably connected to a second gusset panel at a first oblique fold line and an expansion panel foldably connected to the second gusset panel at a second oblique fold line, the at least one gusset further comprising a notch at least partially defined by a free edge of the expansion panel, the free edge extends between the first oblique fold line and the second oblique fold line;

folding the plurality of panels at least partially around an interior of the carton and forming at least one closed end of the carton so that the at least one gusset is foldably connected to the at least one side panel and the at least one closed end of the carton and so that the notch aligns with the handle feature in the at least one closed end of the carton; and expanding the interior of the carton by positioning the at least one gusset from a first position to a second position wherein the carton is expanded.

48. The method of claim 47, wherein the blank further comprises a handle feature in at least one end flap of the plurality of end flaps, and the plurality of panels are folded so that the notch aligns with the handle feature in the at least one closed end of the carton.

* * * * *